US007354241B2

(12) United States Patent
Djeridane et al.

(10) Patent No.: US 7,354,241 B2
(45) Date of Patent: Apr. 8, 2008

(54) ROTOR ASSEMBLY WITH COOLING AIR DEFLECTORS AND METHOD

(75) Inventors: Toufik Djeridane, St. Bruno (CA); Michael Leslie Clyde Papple, Ile des Soeurs (CA); Sri Sreekanth, Mississauga (CA); Alan Juneau, Mount Royal (CA); Dominique Michel Nadeau, Brossard (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 0 days.

(21) Appl. No.: 11/555,753

(22) Filed: Nov. 2, 2006

(65) Prior Publication Data

US 2007/0116571 A1 May 24, 2007

Related U.S. Application Data

(62) Division of application No. 11/002,288, filed on Dec. 3, 2004, now Pat. No. 7,192,245.

(51) Int. Cl.
*F01D 5/08* (2006.01)

(52) U.S. Cl. ..... 415/115

(58) Field of Classification Search ..... 415/115; 416/96 R, 97 R
See application file for complete search history.

(56) References Cited

U.S. PATENT DOCUMENTS 3,609,059 A 9/1971 Wagle
3,853,425 A * 12/1974 Scalzo et al. ..... 416/95
4,275,990 A * 6/1981 Langley et al. ..... 416/95
4,348,157 A 9/1982 Campbell et al.
4,457,668 A 7/1984 Hallinger
4,732,538 A 3/1988 Wollenweber et al.
4,759,688 A * 7/1988 Wright et al. ..... 416/95
4,882,902 A 11/1989 Reigel et al.
5,143,512 A * 9/1992 Corsmeier et al. ..... 415/115
5,211,533 A 5/1993 Walker et al.
5,397,215 A 3/1995 Spear et al.
5,904,470 A 5/1999 Kerrebrock et al.
5,984,636 A 11/1999 Fahndrich et al.
6,065,932 A 5/2000 Dodd
6,077,035 A 6/2000 Walters et al.
6,398,487 B1 6/2002 Wallace et al.
6,550,254 B2 4/2003 Proctor et al.
6,735,956 B2 5/2004 Romani
6,749,400 B2 * 6/2004 Dougherty et al. ..... 416/96 R

* cited by examiner

*Primary Examiner*—Edward K. Look
*Assistant Examiner*—Nathan Wiehe
(74) *Attorney, Agent, or Firm*—Ogilvy Renault LLP

(57) ABSTRACT

A rotor assembly for a gas turbine engine, the rotor assembly comprises a plurality of cooling air deflectors made integral with the rotor disk to redirect air to a manifold at a bottom side of a corresponding blade retention slot on the periphery of the rotor disk.

3 Claims, 4 Drawing Sheets

ROTOR ASSEMBLY WITH COOLING AIR DEFLECTORS AND METHOD

CROSS-RELATED APPLICATION

The present application is a divisional of U.S. patent application Ser. No. 11/002,288, filed Dec. 3, 2004, now U.S. Pat. No. 7,192,245 which is hereby incorporated by reference.

TECHNICAL FIELD

The invention relates generally to gas turbine engines having internally-cooled blades receiving cooling air from a pressurized air supply system.

BACKGROUND OF THE ART

The design of pressurized cooling air supply systems in gas turbine engines is the subject of continuous improvements, including improvements to minimize pressure losses. One location where pressure losses can occur is at the entrance of the internal cooling passages of blades between the blade retention slots and the rotor disc, referred to hereafter as a manifold.

In use, cooling air must enter the manifolds while they rotate with the rotor disk at very high speeds. Moreover, the inlets of the manifolds have a very high tangential velocity since they are located relatively far from the rotation axis. While systems are conventionally provided in gas turbine engines to induce a rotation of the cooling air before entering the manifolds, there is always a relatively large difference in the velocity of the air in front of the entrance of the manifolds and that of the periphery of the rotor disk where these manifolds are located. Air entering in a manifold must accelerate suddenly to compensate for the difference in velocities, which typically results in a tendency of generating re-circulation vortices in the manifolds. These re-circulation vortices increase pressure losses and may also, in certain conditions, prevent air from reaching one or more internal cooling passages in a blade.

SUMMARY OF THE INVENTION

This present invention is generally aimed at reducing pressure losses in a pressurized cooling air supply system.

In one aspect, there is provided a rotor assembly for a gas turbine engine, the rotor assembly comprising: a rotor disk, the rotor disk having an outer periphery provided with a plurality of blade retention slots, each slot being configured and disposed to receive a root portion of a corresponding radially-extending and internally-cooled blade; and a plurality of cooling air deflectors made integral with the rotor disk to redirect air from a forward side of the rotor disk to a manifold at a bottom side of one corresponding blade retention slot, each deflector having a leading edge oriented to collect air in the direction of rotation of the rotor disk, and an trailing edge in alignment with the corresponding manifold.

In another aspect, there is provided a rotor disk for use in a gas turbine engine, the rotor disk having an outer periphery provided with a plurality of blade retention slots configured and disposed to receive a root portion of corresponding radially-extending and internally-cooled blades, the disk comprising a plurality of wedge-shaped solid deflectors, each located between two adjacent slots, each deflector having a leading edge with a maximum thickness, and a trailing edge with a minimum thickness adjacent to the slot in which air is deflected.

In a further aspect, there is provided a method of deflecting cooling air prior to entering internal cooling passages provided in an internally-cooled blade of a gas turbine engine, the blade being mounted at a periphery of a rotor disk of a rotor assembly, the method comprising: supplying cooling air at a forward side of the rotor disk; receiving the cooling air on a deflector provided on the rotor disk; separating the cooling air at a leading edge of the deflector; and deflecting the cooling air received on an upper surface of the deflector towards an adjacent manifold that is in fluid communication with the internal cooling passages of the blade, the deflected cooling air flowing into the manifold in a direction substantially perpendicular with reference to an inlet of the manifold.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
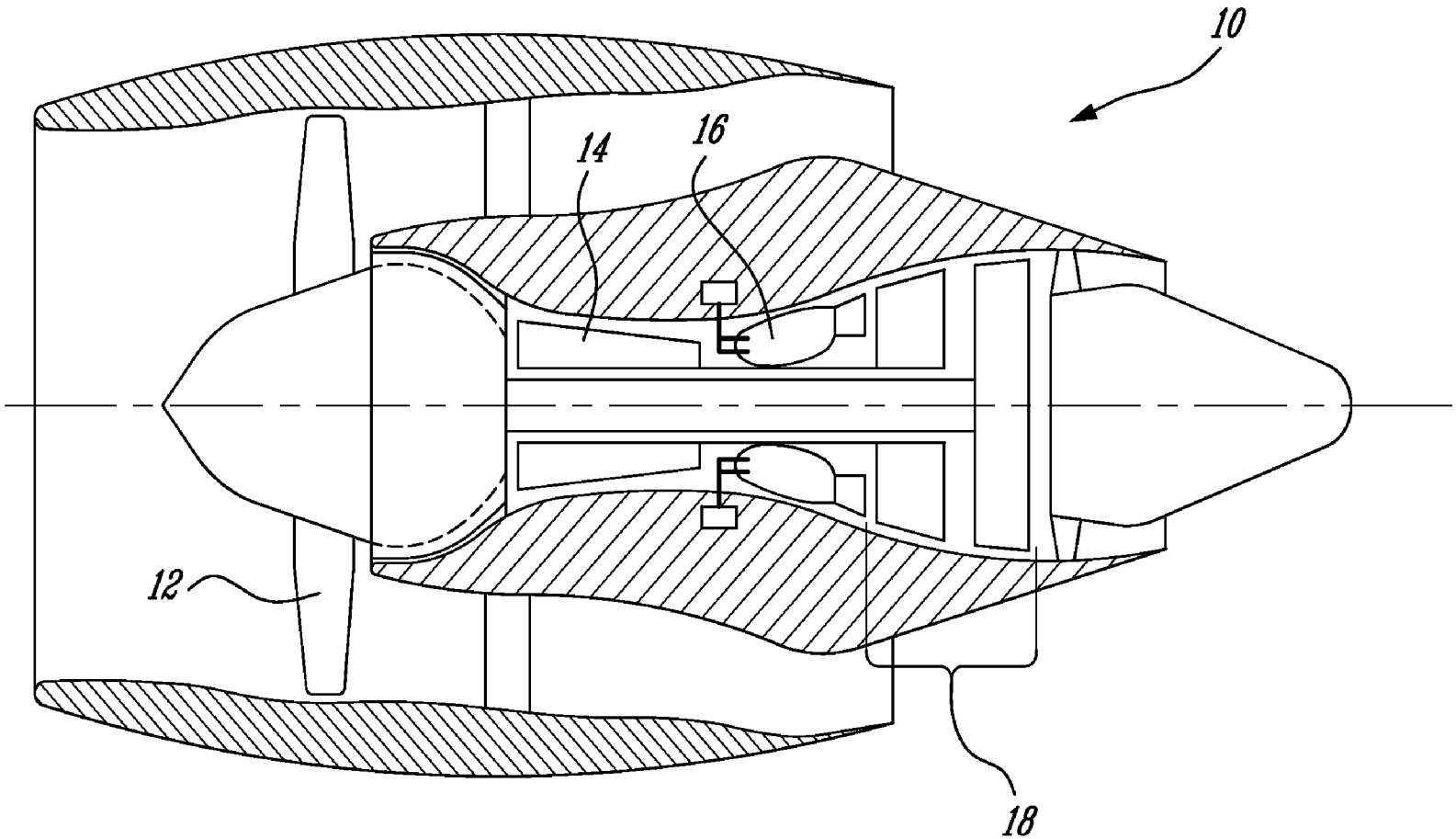
FIG. 1 shows a generic gas turbine engine to illustrate an example of a general environment in which the invention can be used.

FIG. 1 illustrates an example of a gas turbine engine 10 of a type preferably provided for use in subsonic flight, generally comprising in serial flow communication a fan 12 through which ambient air is propelled, a multistage compressor section 14 for pressurizing the air, a combustor 16 in which the compressed air is mixed with fuel and ignited for generating an annular stream of hot combustion gases, and a turbine section 18 for extracting energy from the combustion gases. This figure illustrates an example of the environment in which the improved cooling air deflectors can be used.

Figure 2:
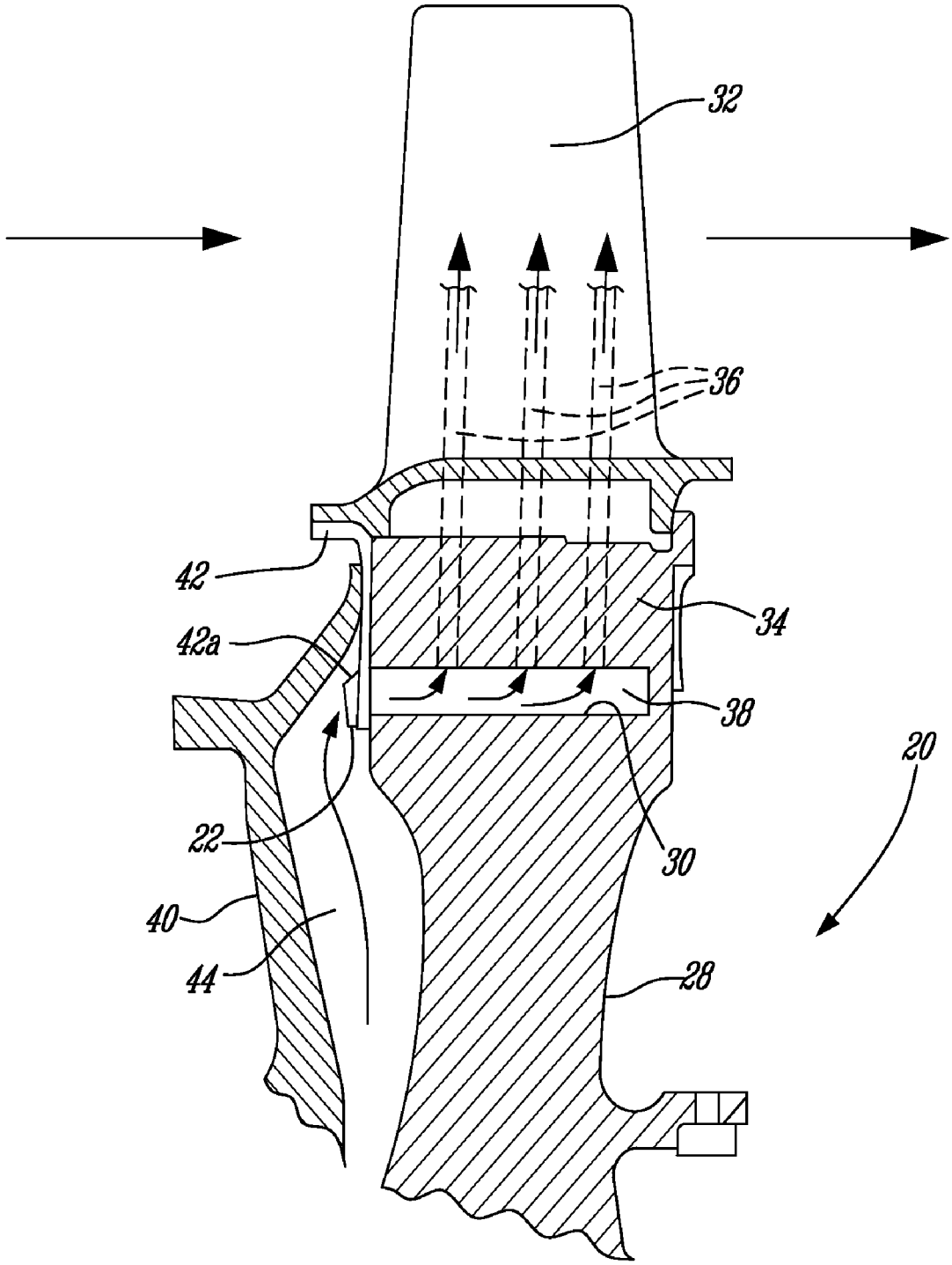
FIG. 2 is a cross-sectional view of an example of a turbine section including a deflector in accordance with a preferred embodiment of the present invention.

FIG. 2 illustrates an example of a rotor assembly 20 in which is provided the improved air deflectors 22. Although FIG. 2 shows the rotor assembly 20 being provided in the turbine section 18 of a conventional gas turbine engine 10, it will be understood that the invention is equally applicable to a rotor assembly 20 used in the compressor section 14.

The rotor assembly 20 comprises a rotor disk 28 having a plurality of blade retention slots 30 symmetrically-disposed on its outer periphery, each slot 30 receiving a corresponding blade 32. Each blade 32 comprises a root section 34 which is attached to a corresponding blade retention slot 30 and is prevented from moving out its slot 30 using rivets (not shown) or another mechanical connector. Each blade 32 also comprises one or several internal cooling passages 36 in which flows a secondary air path. Air from this secondary air path is bled from the engine compressor 14 and is used as cooling air for the blade 32.

As also shown in FIG. 2, the rotor assembly 20 further comprises a forwardly mounted coverplate 40 which contains and directs the pressurized cooling air to each manifold 38 provided under each blade 32, between the root portion 34 and the bottom of the blade retention slot 30 thereof. Cooling air flows radially outward between the coverplate 40 and rotor disc 28 until it reaches the manifolds 38. From the manifolds 38, the cooling air enters the internal cooling passages 36 formed in the blades 32. The coverplate 40 preferably covers almost the entire forward surface of the rotor disc 28.

An annular seal 42, also called "L-seal", is provided between the coverplate 40 and the forward radially outward edge of the rotor disk 28. The L-seal 42 is firmly engaged between the two parts and is one of the parts of the rotor assembly 20. Its main purpose is to minimize the flow of secondary cooling air from a plenum 44, which is located in the space between the coverplate 40 and the rotor disk 28, directly to the primary air flow of the engine 10.

The cooling air deflector 22 is in alignment with the manifold 38 under each blade 32 and is outwardly projecting inside the plenum 44. In the embodiment shown in FIG. 2, each cooling air deflector 22 is provided on a radially-extending flange 42*a* of the L-seal 42.

The flange 42*a* extends inward to cover to inlet of the manifold 38 under the blade 32. There is one cooling air deflector 22 for each blade 32.

Figure 3:
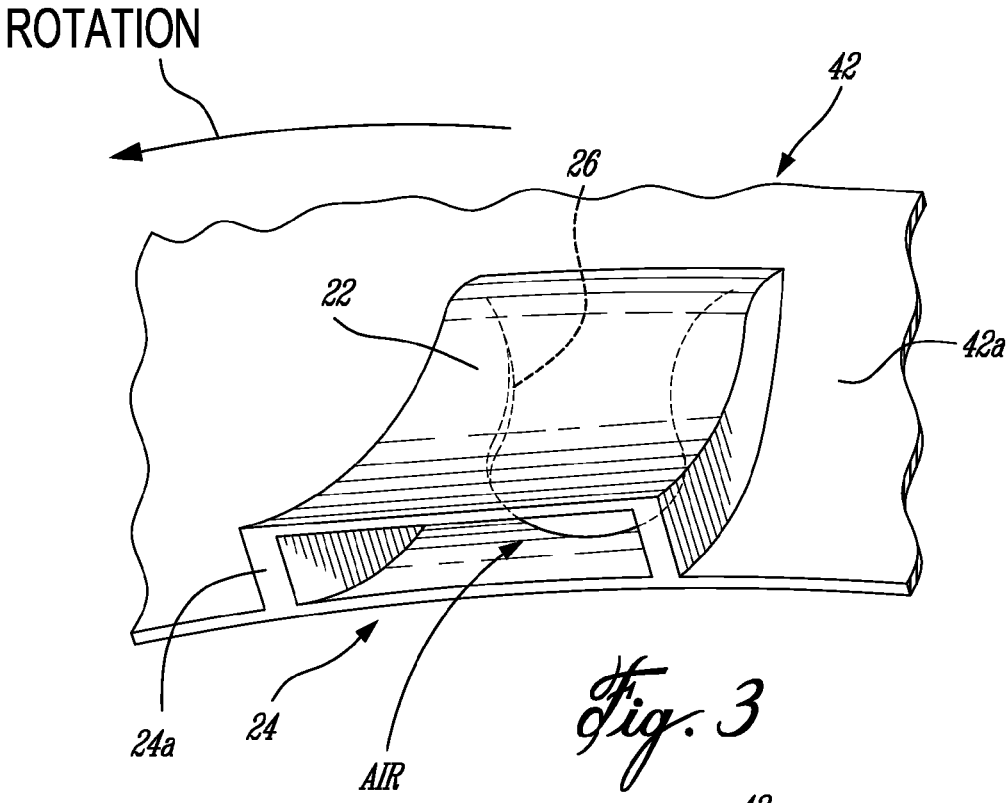
FIG. 3 is an enlarged semi-schematic view of an example of one cooling air deflector provided on an L-seal.

FIG. 3 shows a possible model for the cooling air deflectors 22 provided on the L-seal 42. This deflector 22 has a substantially rectangular inlet 24 and is somewhat curved along its length in the direction of the rotation. Its leading edge 24*a* is preferably straight. This illustrated model would typically be used on small gas turbine engines, where the diameter of the rotor disk 28 is relatively small and where the cooling air still has a relatively high radial velocity in the plenum 44 at the level of the deflectors 22. Air enters through the inlet 24 at a certain angle relative to the deflector 22 and is slightly redirected until it exits the deflector 22 through an outlet 26 located on an opposite side of the L-seal 42. The outlet 26 preferably has a shape corresponding to that of the blade retention slot 30 and is in alignment therewith. Internal walls of the deflector 22 are preferably designed to make a progressive transition from the rectangular-shaped inlet 24 to the slot-shaped outlet 26. Hence, the deflector 22 scoops the air in the plenum 44 and progressively redirects the cooling air into the manifold 38, thereby substantially reducing the risks of having re-circulation vortices in the manifold 38.

Figure 4:
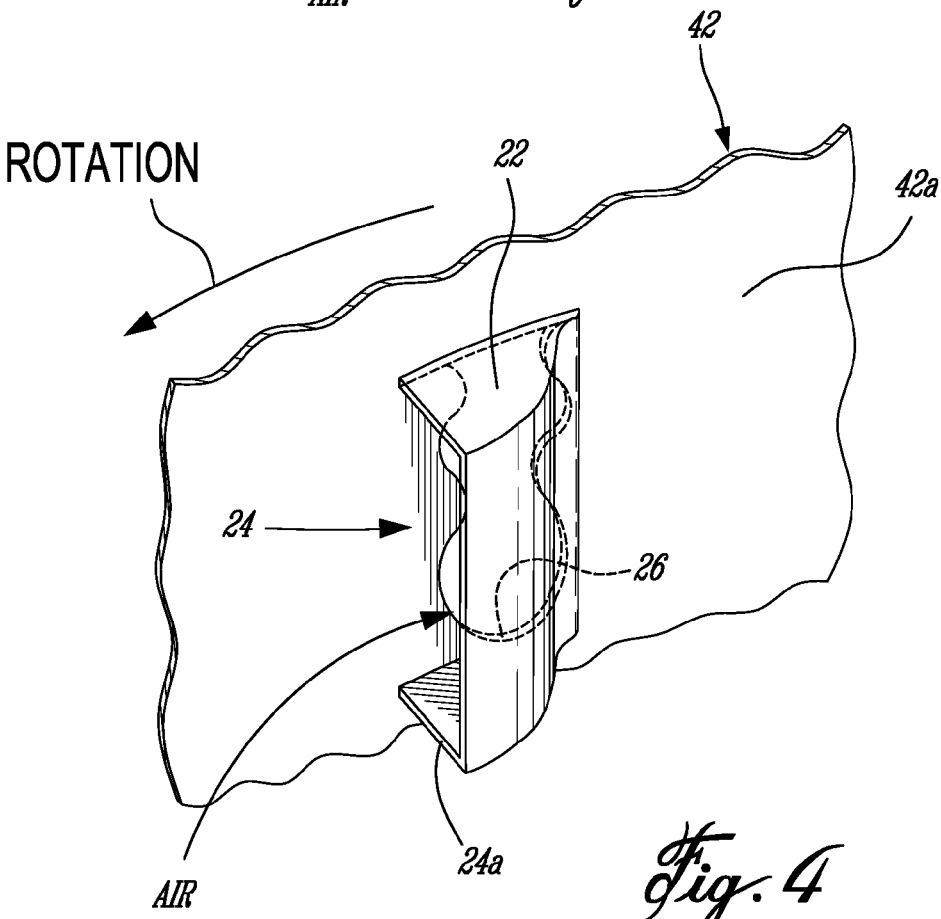
FIG. 4 is an enlarged semi-schematic view of another example of one cooling air deflector provided on an L-seal.

FIG. 4 shows another possible model for the deflectors 22 mounted on the radially-extending flange 38 of the L-seal 42. The inlet 24 of this deflector 22 also has a rectangular inlet 24 but its largest dimension is oriented radially. Its leading edge 24*a* is preferably straight. However, in this case, the leading edge 24*a* also separates the air flow in two, the second part flowing towards the subsequent deflector (not shown). This illustrated embodiment would typically be used on a relatively large gas turbine engine, where air in the plenum 44 has lost most of its radial velocity at the level of the manifolds 38. Air is scooped by the deflector 22 and is forced to follow a curved path and to exit through an outlet 26 made through the L-seal 42. The outlet 26 preferably has a shape corresponding to that of the blade retention slot 30 and is in alignment therewith. Internal walls of the deflector 22 are preferably designed to make a progressive transition from the rectangular-shaped inlet 24 to the slot-shaped outlet 26.

Figure 5:
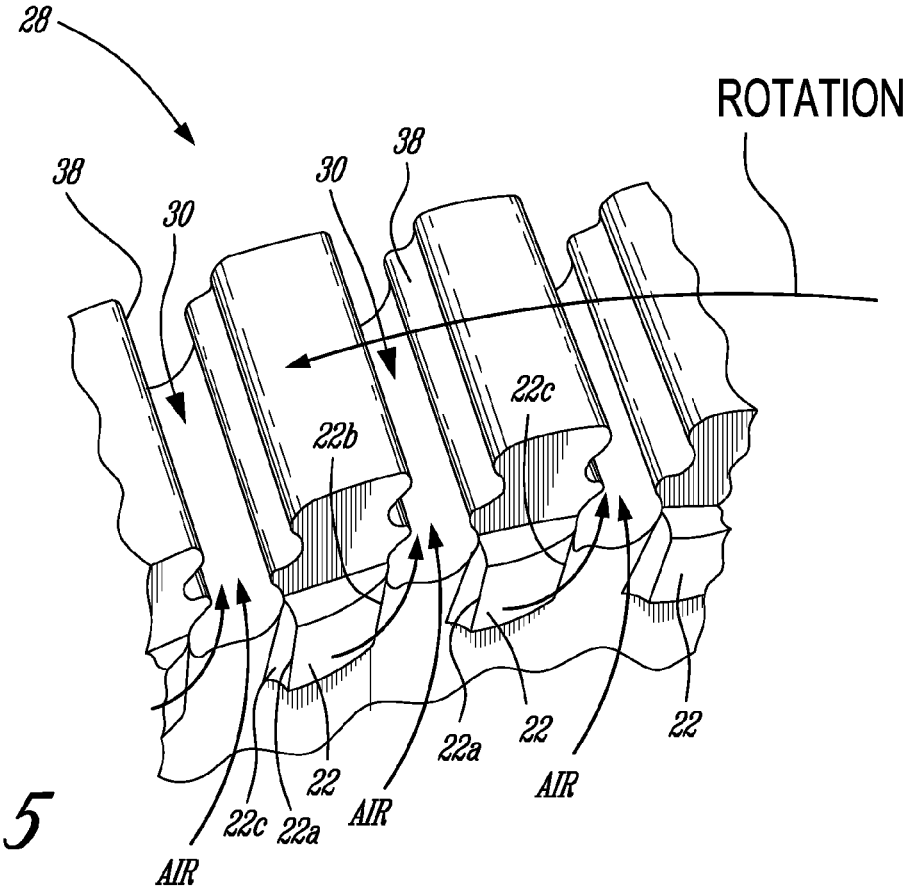
FIG. 5 is an enlarged semi-schematic view of an example of several cooling air deflectors made integral with the rotor disk.
Figure 6:
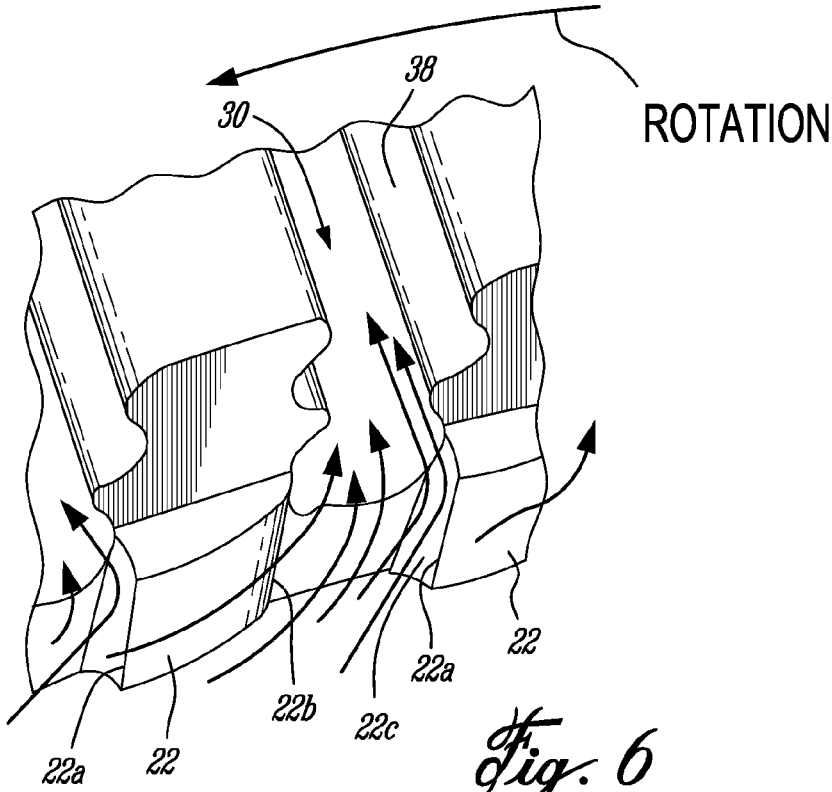
FIG. 6 is a further enlarged semi-schematic view of some of the air deflectors shown in FIG. 5.

FIG. 5 also shows another possible embodiment for cooling air deflectors 22. In this case, each deflector 22 is made integral with the rotor disk 28. They are preferably in the form of a wedge-shaped and solid protrusion positioned between each slot 30 in which the root of a blade 32 will be positioned. The thickness of the wedge-shape protrusions decreases with reference to the direction of rotation. Hence, the thickness of a protrusion is maximum at its radially-extending leading edge 22*a* and minimum at its radially-extending trailing edge 22*b*. The inlet 24 of the deflector 22 is a zone above the leading edge 22*a* and its outlet is a downstream zone around the bottom of the blade retention slot 30. The leading edge 22*a* is preferably radially-extending and straight to cut the flow of air at the edge of an upper surface 22*c*, which upper surface is preferably curved around a radial axis. In use, this creates the second half of an aerodynamic scoop, as shown in FIG. 6.

As can be appreciated, the present invention can substantially mitigate the problem of having re-circulation vortices inside each manifold 38 by redirecting the flow of air while it accelerates. The flow of air is thus more perpendicular to the inlet of the manifold 38, which reduces the risks of having re-circulation vortices. Also, the deflectors in accordance with the present invention can be provided as retrofit parts in gas-turbine engines that were not originally designed with them.

The above description is meant to be exemplary only, and one skilled in the art will recognize that changes may be made to the embodiments described without department from the scope of the invention disclosed. It can be used in either a turbine section or a compressor section of a gas turbine engine. The exact shape of the deflectors can be different from what is illustrated herein. Still other modifications which fall within the scope of the present invention will be apparent to those skilled in the art, in light of a review of this disclosure, and such modifications are intended to fall within the appended claims.

What is claimed is:

1. A rotor disk for use in a gas turbine engine, the rotor disk having an outer periphery provided with a plurality of blade retention slots configured and disposed to receive a root portion of corresponding radially-extending and internally-cooled blades, the disk comprising a plurality of wedge-shaped solid deflectors, each located between two adjacent slots, each deflector having a radially-extending leading edge with a maximum thickness, and a trailing edge with a minimum thickness adjacent to the slot in which air is deflected.

2. The rotor disk as defined in claim 1, wherein the leading edge of each deflector is straight.

3. The rotor disk as defined in claim 1, wherein each deflector has a curved surface between the leading and trailing edges.

* * * * *